US011299339B2

(12) United States Patent
DaCosta

(10) Patent No.: US 11,299,339 B2
(45) Date of Patent: Apr. 12, 2022

(54) SHOE HOLDER

(71) Applicant: Ian Earl DaCosta, Yorktown Heights, NY (US)

(72) Inventor: Ian Earl DaCosta, Yorktown Heights, NY (US)

( * ) Notice: Subject to any disclaimer, the term of this patent is extended or adjusted under 35 U.S.C. 154(b) by 33 days.

(21) Appl. No.: 16/790,715

(22) Filed: Mar. 27, 2020

(65) Prior Publication Data

US 2021/0300672 A1 Sep. 30, 2021

(51) Int. Cl.

| | |
|---|---|
| ***B65D 85/18*** | (2006.01) |
| ***B65D 21/02*** | (2006.01) |
| ***A47F 7/08*** | (2006.01) |
| ***B65D 25/20*** | (2006.01) |

(52) U.S. Cl.

CPC ..... *B65D 85/187* (2013.01); *A47F 7/08* (2013.01); *B65D 21/0209* (2013.01); *B65D 25/20* (2013.01)

(58) Field of Classification Search

CPC .. B65D 85/187; B65D 21/0209; B65D 25/20; A47F 7/08

USPC ..... 220/288

See application file for complete search history.

(56) References Cited

U.S. PATENT DOCUMENTS 3,478,890 A * 11/1969 John ..... A43D 3/1425 211/37

5,636,751 A * 6/1997 Frank ..... A47B 61/04 211/163

* cited by examiner

*Primary Examiner* — Andrew D Perreault

(74) *Attorney, Agent, or Firm* — Notaro, Michalos & Zaccaria P.C.

(57) ABSTRACT

The Shoes Stax Pro is an apparatus that allows you to store multiple pairs of shoes in a compact area. It utilizes a series of springs and tongs that allow you to hang shoes and other footwear both on the outside and the inside of the box shaped apparatus. It stores more shoes in the area that is usually taken by one or two pairs of shoes. It can be stacked one atop the other to increase the number of shoes that can be stored.

11 Claims, 16 Drawing Sheets

SHOE HOLDER

CROSS-REFERENCE TO RELATED APPLICATIONS

This application claims the benefit of and priority to U.S. Provisional Patent Application No. 62/810,255 filed on Feb. 25, 2019 and titled, "Shoe Stax Pro." Said application is incorporated herein by reference in its entirety.

FIELD OF THE INVENTION

The invention relates generally to a footwear display and storage apparatus.

BACKGROUND OF THE INVENTION

The storage and display of shoes in households throughout the world has not changed much over the years. Shoes are one of the clothing items that people have a lot of but presents also a challenge to store. Lining shoes on the floor or on a shelf are some of the most popular ways of storing shoes. These methods, however, often prove to be an inefficient way of storage. With these systems, the only way of adding more storage space is to add another row of shelves or find more space on the floor. Adding more shelves of equal length only allow you to store an equal amount of shoes while taking up valuable closet space.

Other methods of storing shoes is to place them on a "shoe caddy". This is a two to four shelf based free standing furniture. Like the shelves in a closet, it allows you to store shoes side by side on different levels. Other methods include "shoe bags." This system allows you to place your shoes in plastic sections which are then hung-over a door. These systems are not the most efficient, nor aesthetically pleasing way of storing shoes.

The Shoes Stax Pro provides a modern, more efficient and aesthetically pleasing way of storing shoes.

SUMMARY OF THE INVENTION

It is an object of the present invention to provide a line of footwear storage and display systems that stores 2 to 8 pairs of shoes in the same amount of space that usually stores 1 to 2 pairs of shoes. The Shoes Stax Pro does this in a very efficient and more visually pleasing manner. This apparatus for storing and displaying shoes and other footwear, can be made out of a variety of materials including, but not limited to: plastics, wood, metal, hard cardboard and carbon fiber. Whatever material is used, this apparatus can be made customizable to the user.

The Shoes Stax Pro can also be made to accommodate more shoes. By stacking one apparatus atop another by way of a "Lazy Susan" attachment, you can double the total number of shoes.

The Shoes Stax Pro is also available in an elongated model, allowing you to store twice as many shoes as the standard size apparatus.

This device for storing and displaying shoes and other footwear, solves the storage problems presented by other systems by taking up less space. It is a square shaped compact apparatus that utilizes as series of slats and tongs on which you hang shoes, instead of placing them side by side. This system allows you store shoes on all four sides, and on the inside of those sides.

This system of hanging shoes in an upright position and back to back, allows you to store 1 to 8 pairs of shoes in a standard sized Shoe Stax Pro and up to 18 pairs in an elongated model.

DETAILED DESCRIPTION OF THE INVENTION

The present invention as generally indicated in the Figures, is a footwear storage and display system. The apparatus when made from plastic, can be made by injection molding. It can also be made out of wood by carving and or molded. Placed on a shelf or free standing on the floor, the apparatus can be rotated so that shoes and other footwear are accessible from all sides. (Note that in the Figures, only certain repeated parts are numbered, for legibility of the Figures.)

Figure 10:
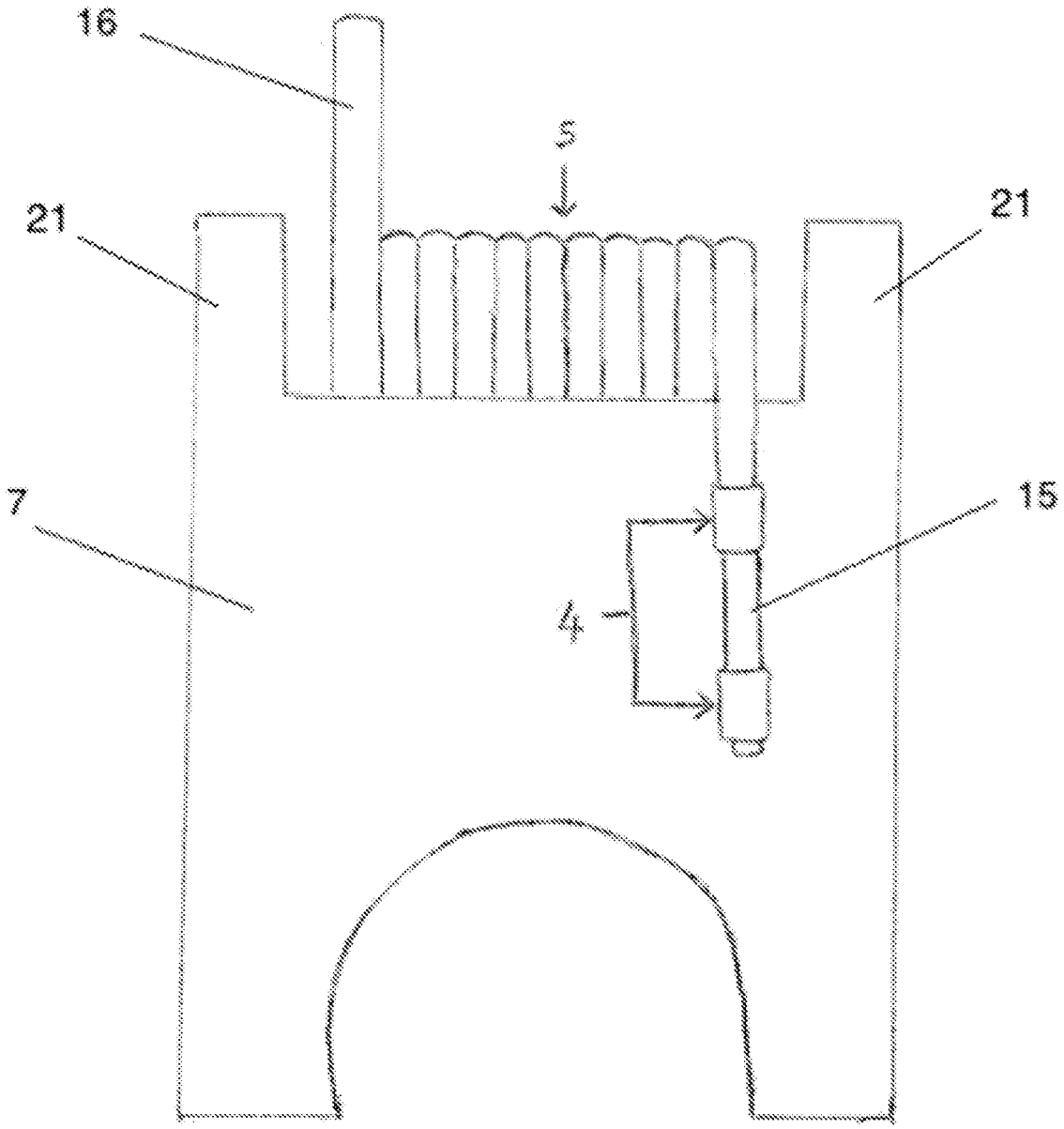
FIG. 10 is a view of a torsion spring attached to a tong.

The apparatus is box-shaped with a series of tongs 7 placed on the inside and outside of the apparatus. As is observed in FIG. 4, the tongs 7 are raised and held in place by torsion springs 5. Tongs 7 are folded down except when raised for a shoe 100 to be hung. Tongs 7 may be formed with a convex curvature 14 on an outer surface thereof to allow tongs 7 to comfortably fit any shoe 100. The torsion spring 5 holds the tong 7 at a 10° angle which prevents the shoe from falling off. The cross bar 20 holds the torsion spring 5 through holes attached to the cross slat 12. The torsion springs 5 are attached to the tong 7 and cross slat 12 by spring support holders 4. More particularly, as shown in the Figures, most clearly shown in FIG. 10, a torsion spring 5 has a coil portion 15 with a first arm 16 disposed at one end of coil portion 15 and a second arm 17 disposed at a second end of coil portion 15. The respective first arm 15 is attached by spring support holders 4 to a tong 7 and the second arm 16 is attached by spring support holders 4 to a slat 11. Cross bar 20 passes through coil portion 15 and knuckles 21 of tong 7 to attach tong 7 and spring 5 to cross slat 12. In a standard sized apparatus, this allows for the hanging of one pair of shoes on each side. Additionally, two to four pairs of shoes are able to be stored on the inside of the apparatus.

Figure 2:
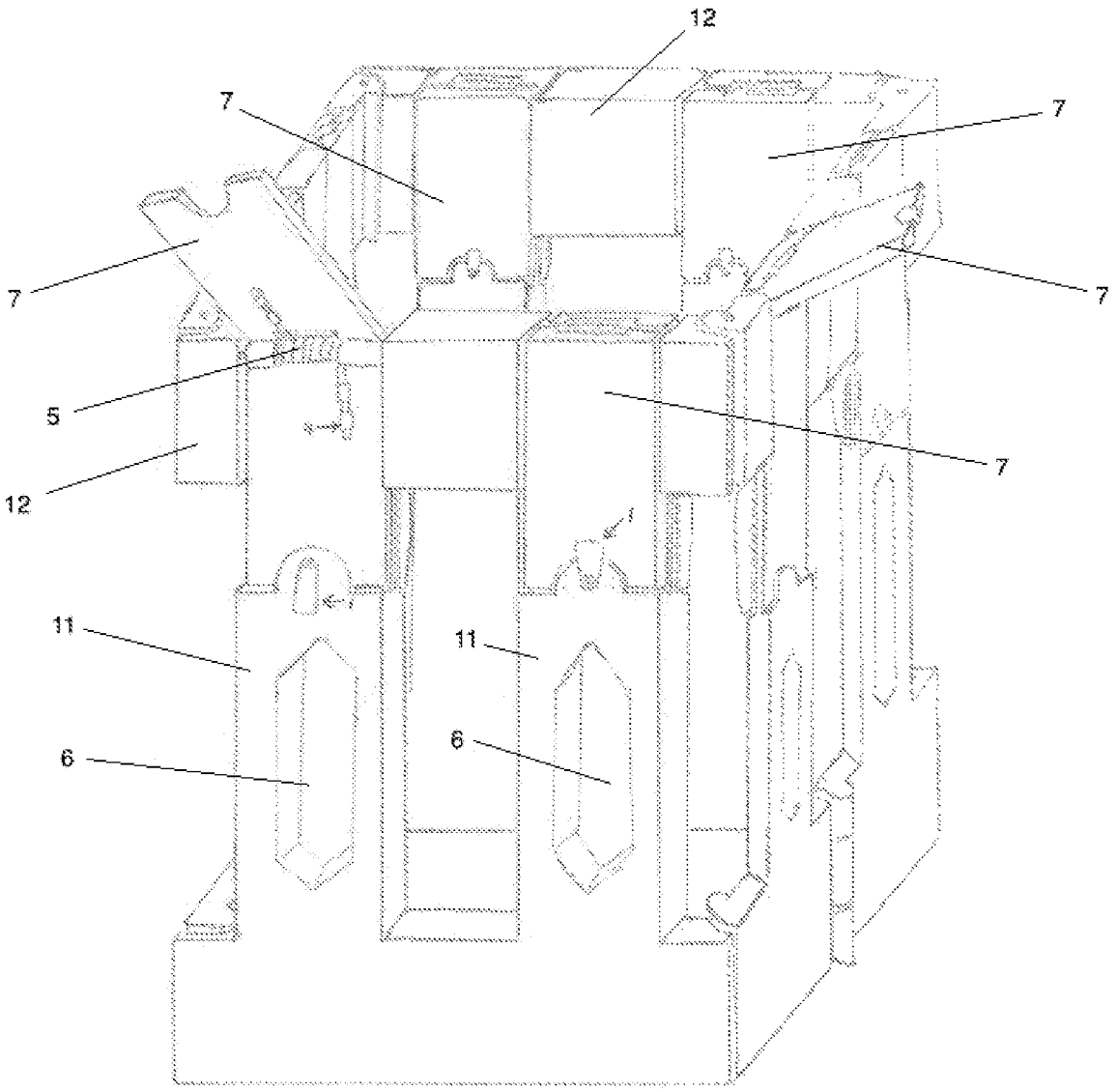
FIG. 2 is a detailed drawing of the apparatus.
Figure 2A:
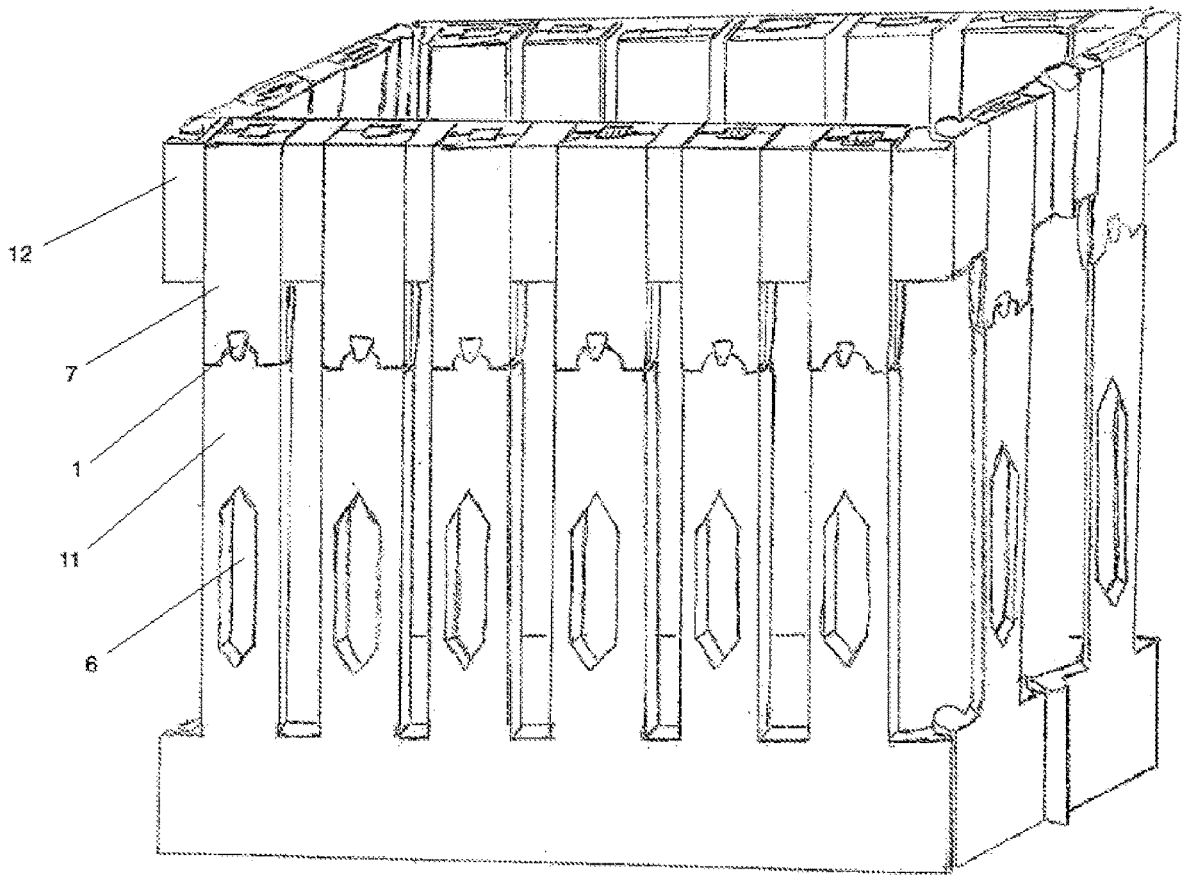
FIG. 2A is a detailed drawing of an extended sized apparatus.
Figure 3:
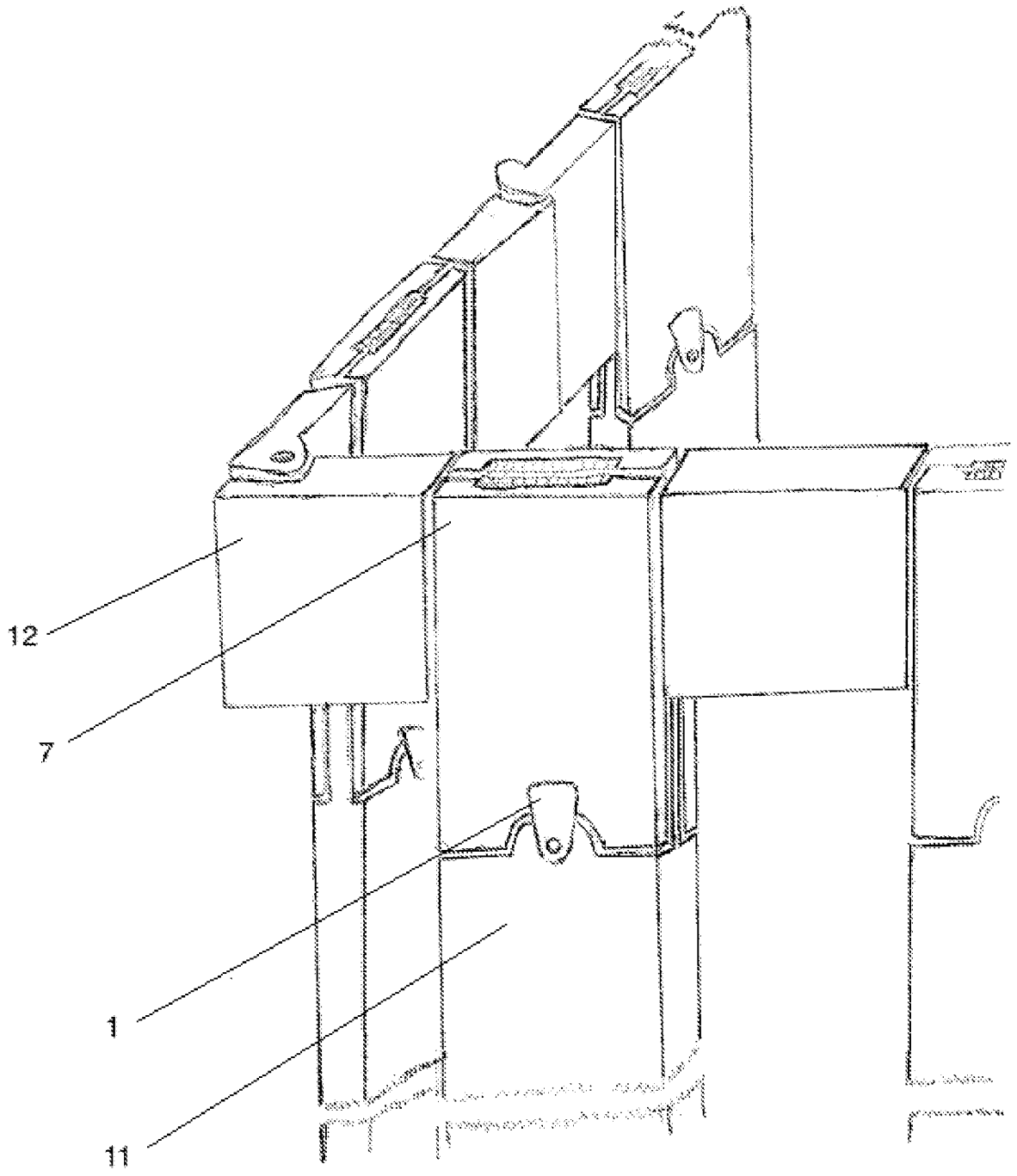
FIG. 3 is a close up view of a corner section of the apparatus.

The extended model as seen in FIG. 2A is able to accommodate up to 16 pairs of shoes.

Figure 11:
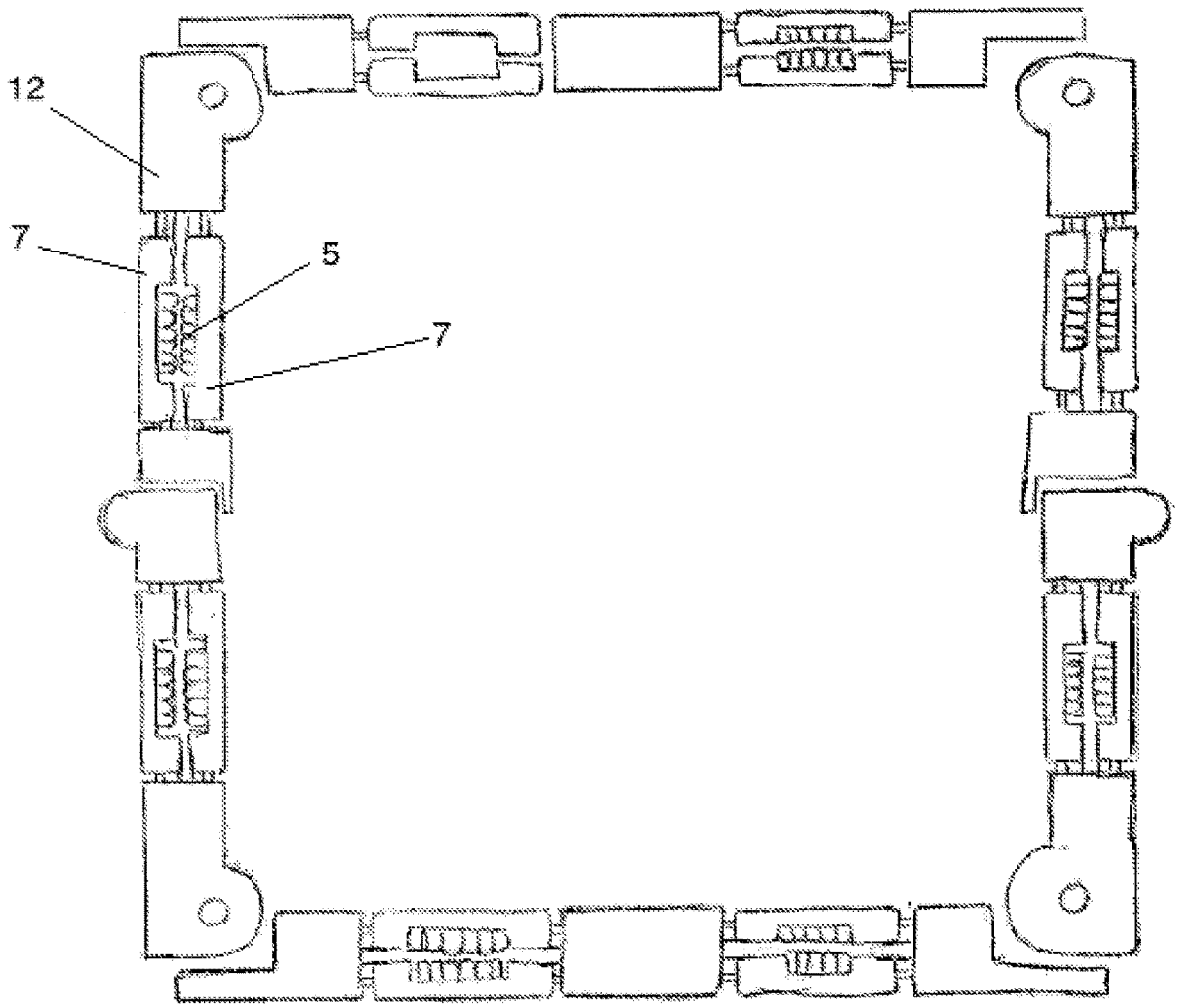
FIG. 11 is a top view of the Shoes Stax Pro showing attachment holes for attaching a Lazy Susan.

The side section, and the corners of the apparatus, are hinged as seen in the top view in FIG. 11. The folding hinges consists of raised knobs and knob holes which fit inside each other. This allows for the apparatus to be folded for shipping and storage. The front and back of the apparatus stay in a fixed position.

Figure 1:
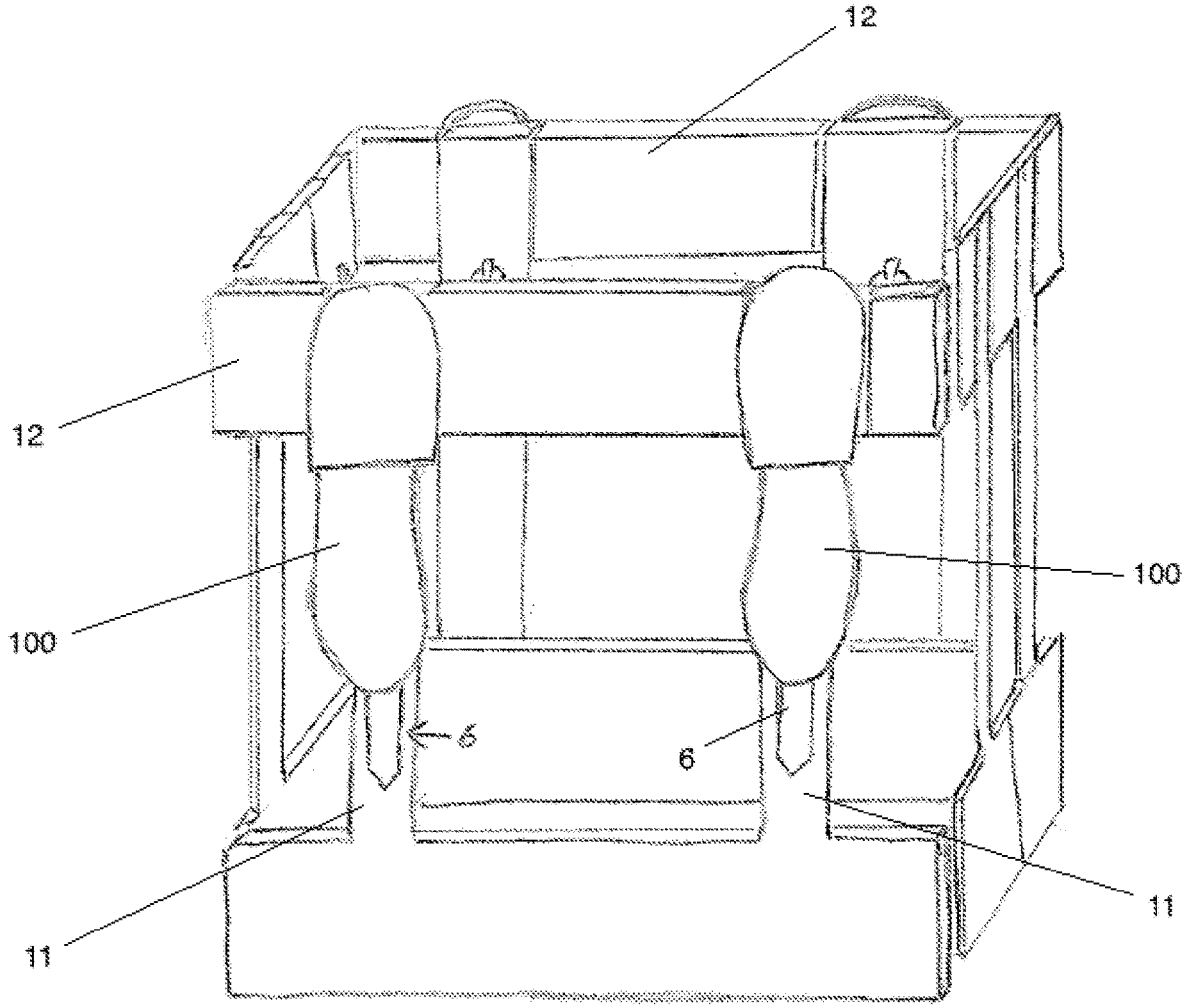
FIG. 1 is a perspective view of a standard sized Shoes Stax Pro apparatus.
Figure 4:
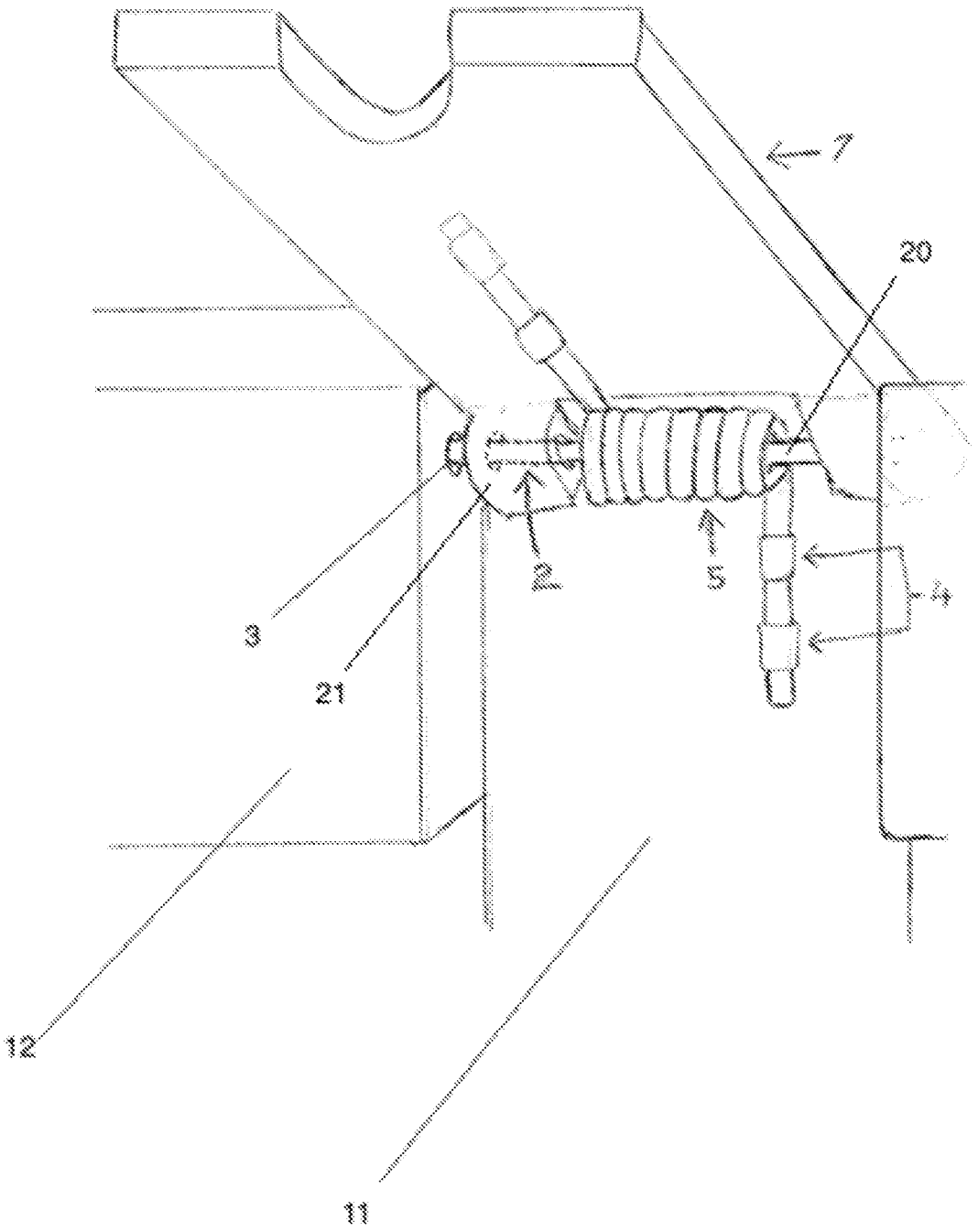
FIG. 4 is a close up view of a raised tong, torsion spring, and cross bar on a cross slat.
Figure 5:
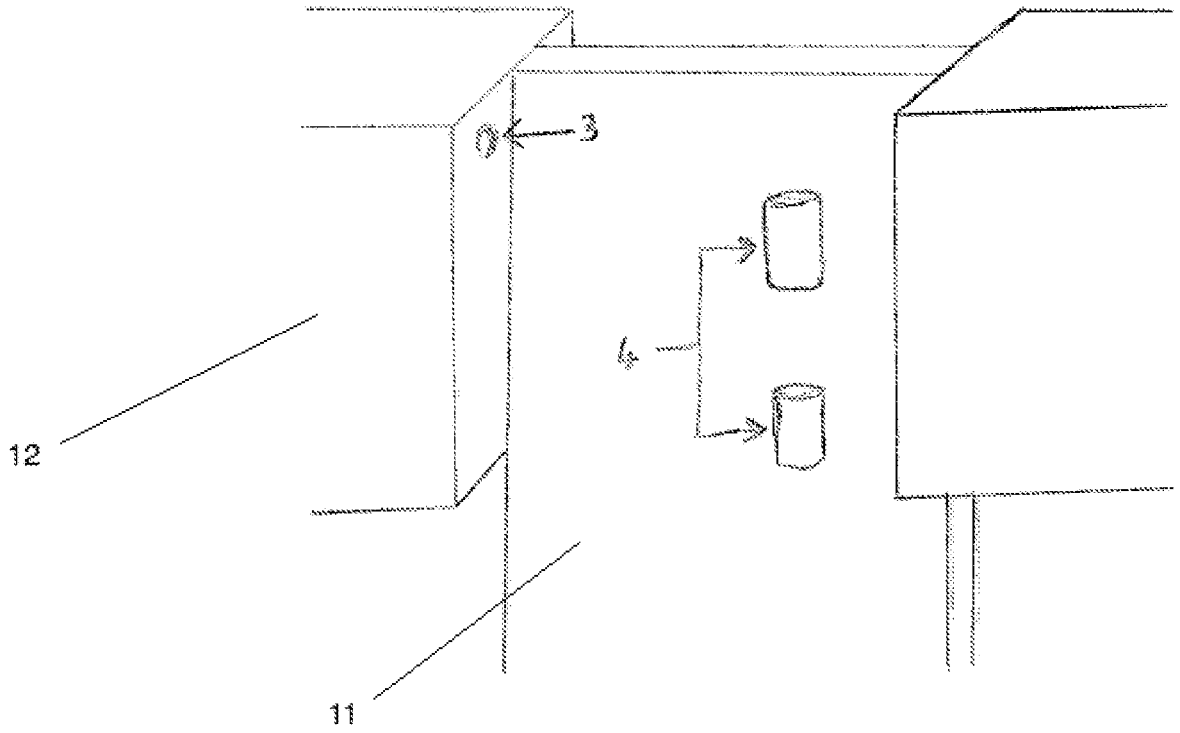
FIG. 5 is a close up view of the spring support holder on the slat and holes on the cross slat.
Figure 6:
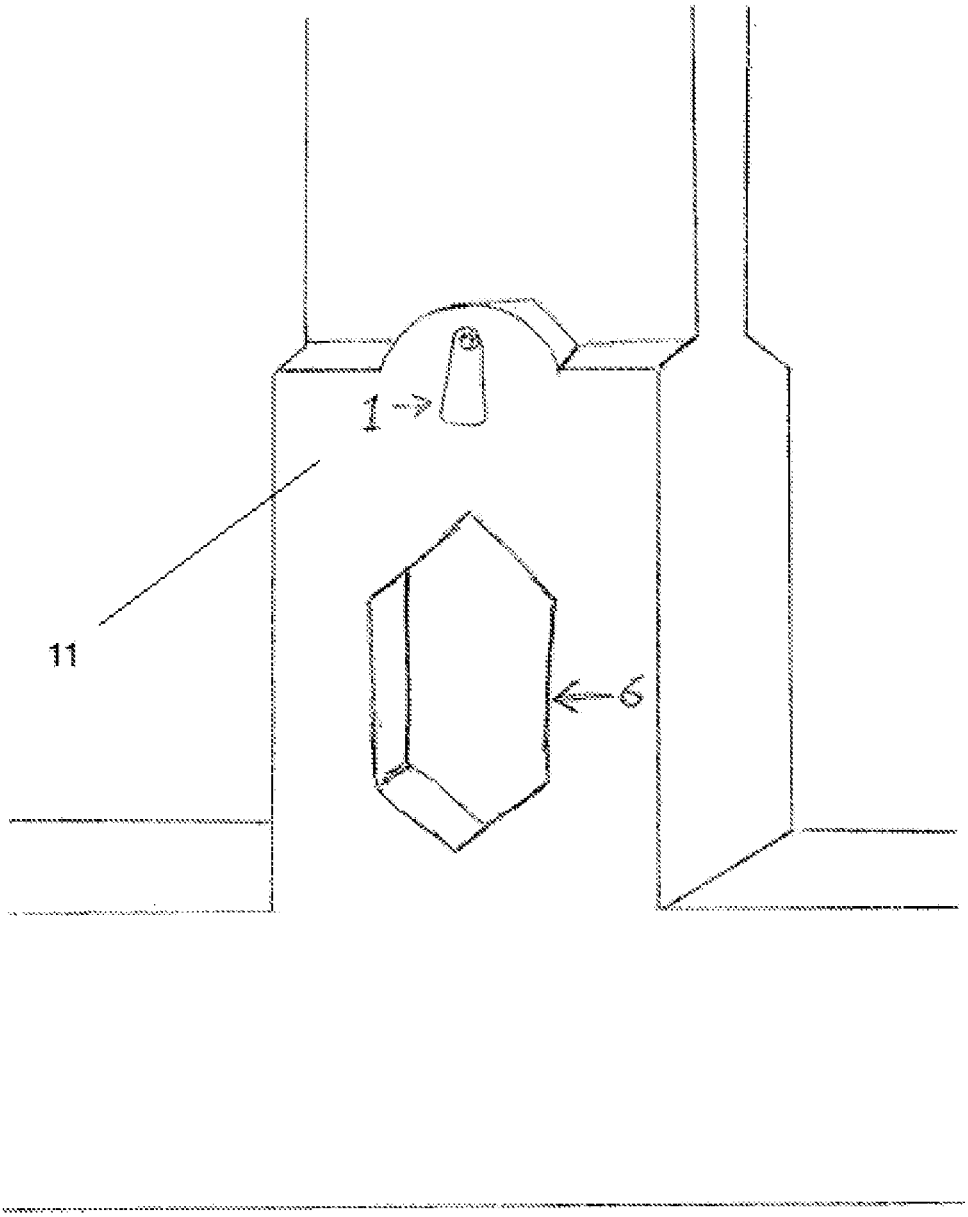
FIG. 6 is a close up view of a slat showing the holding clip used the hold the tong in place for shipping and when not in use. Visible also is the cut out used to assist in stopping the shoe from moving side to side.
Figure 7:
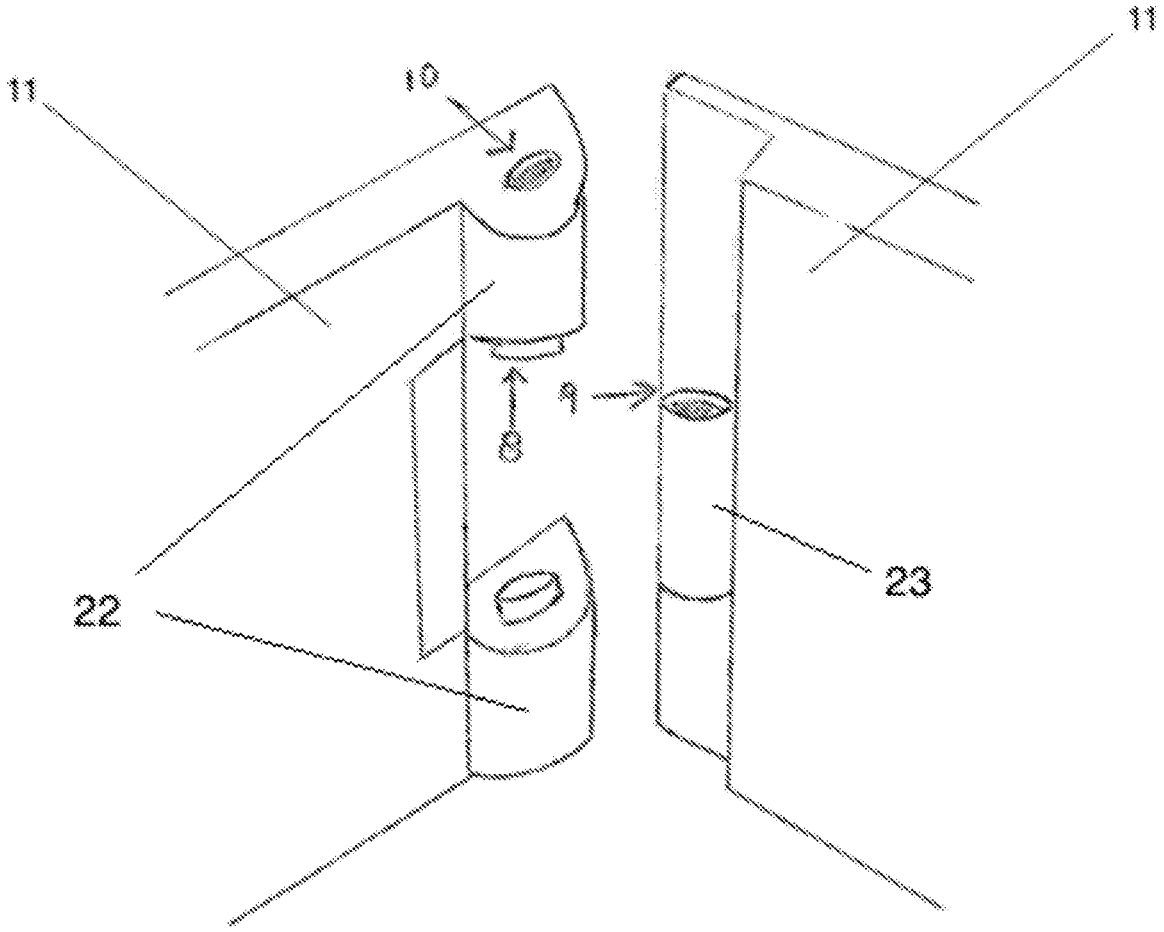
FIG. 7 is a close up of one of several folding hinges which allows the apparatus to be folded for storage and shipping.
Figure 8:
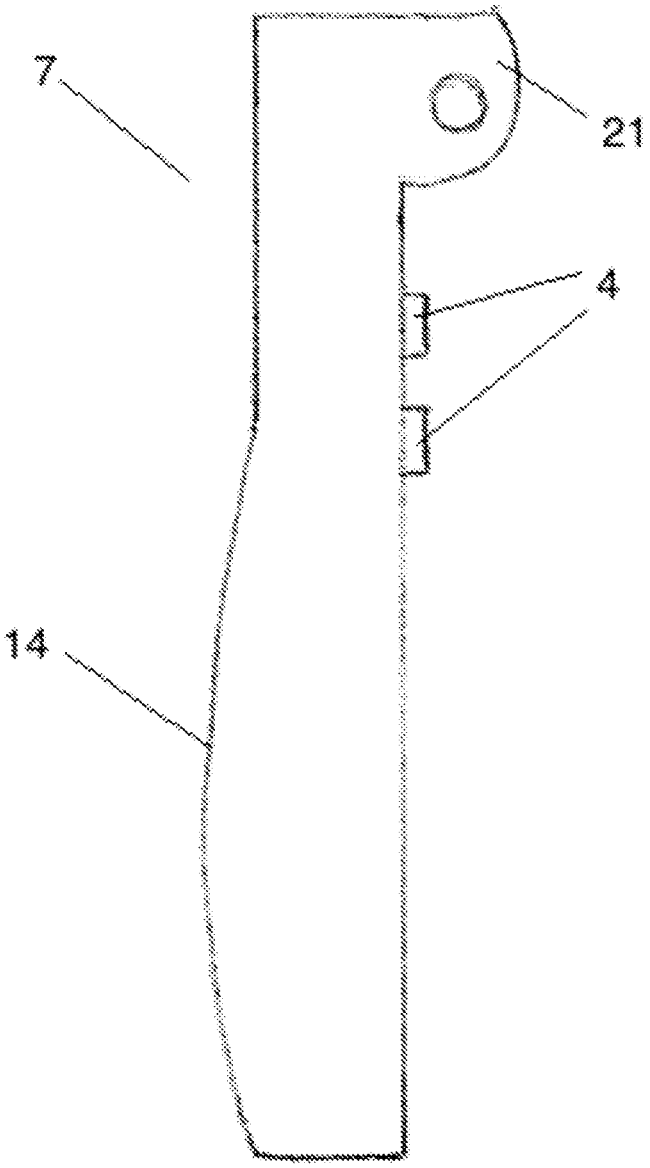
FIG. 8 is a side view of a tong on which shoe is hung. There is a slight curvature allowing the tong to fit comfortably inside any shoe.
Figure 9:
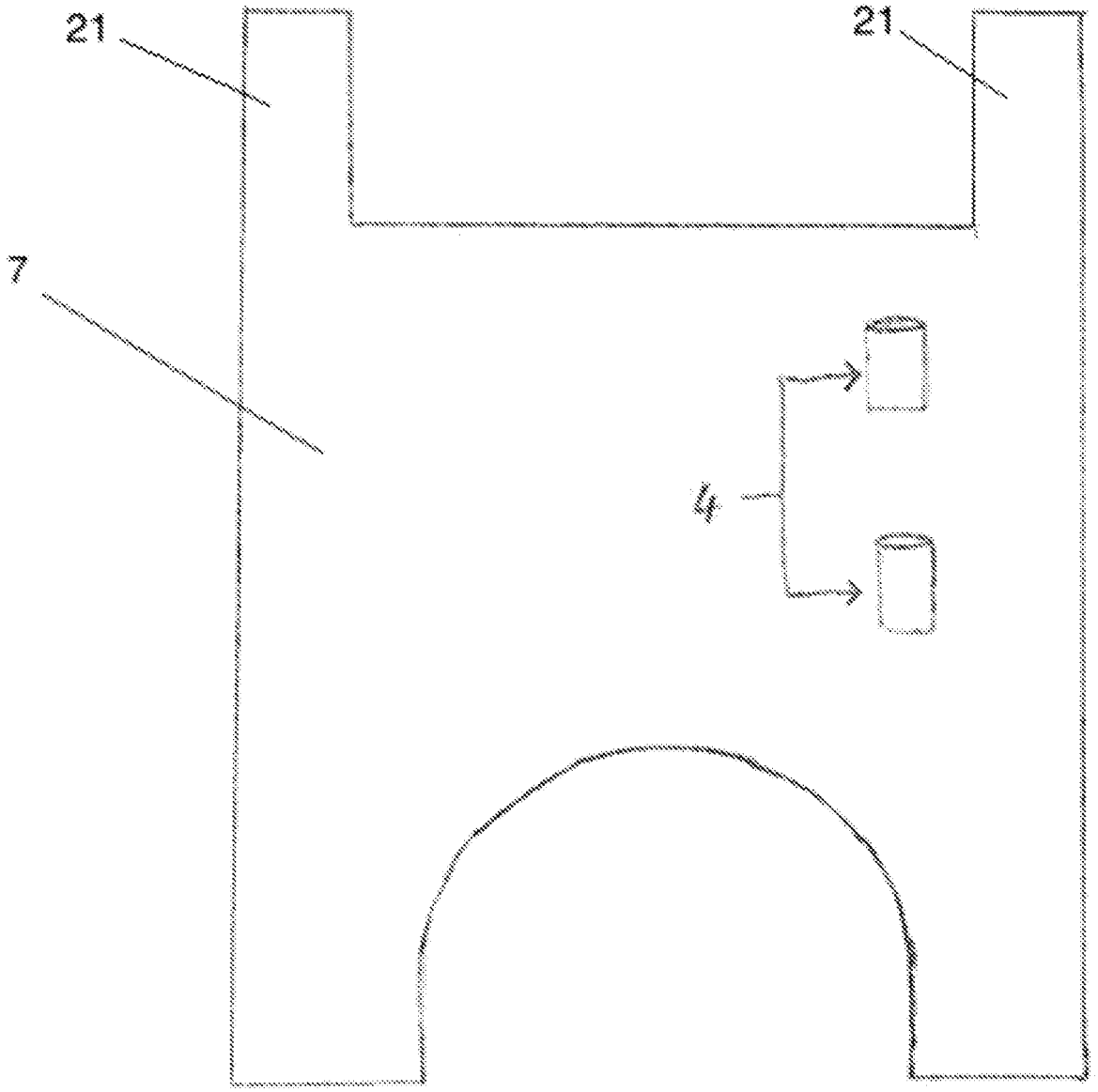
FIG. 9 is a rear view of tong showing spring support holders.
Figure 12:
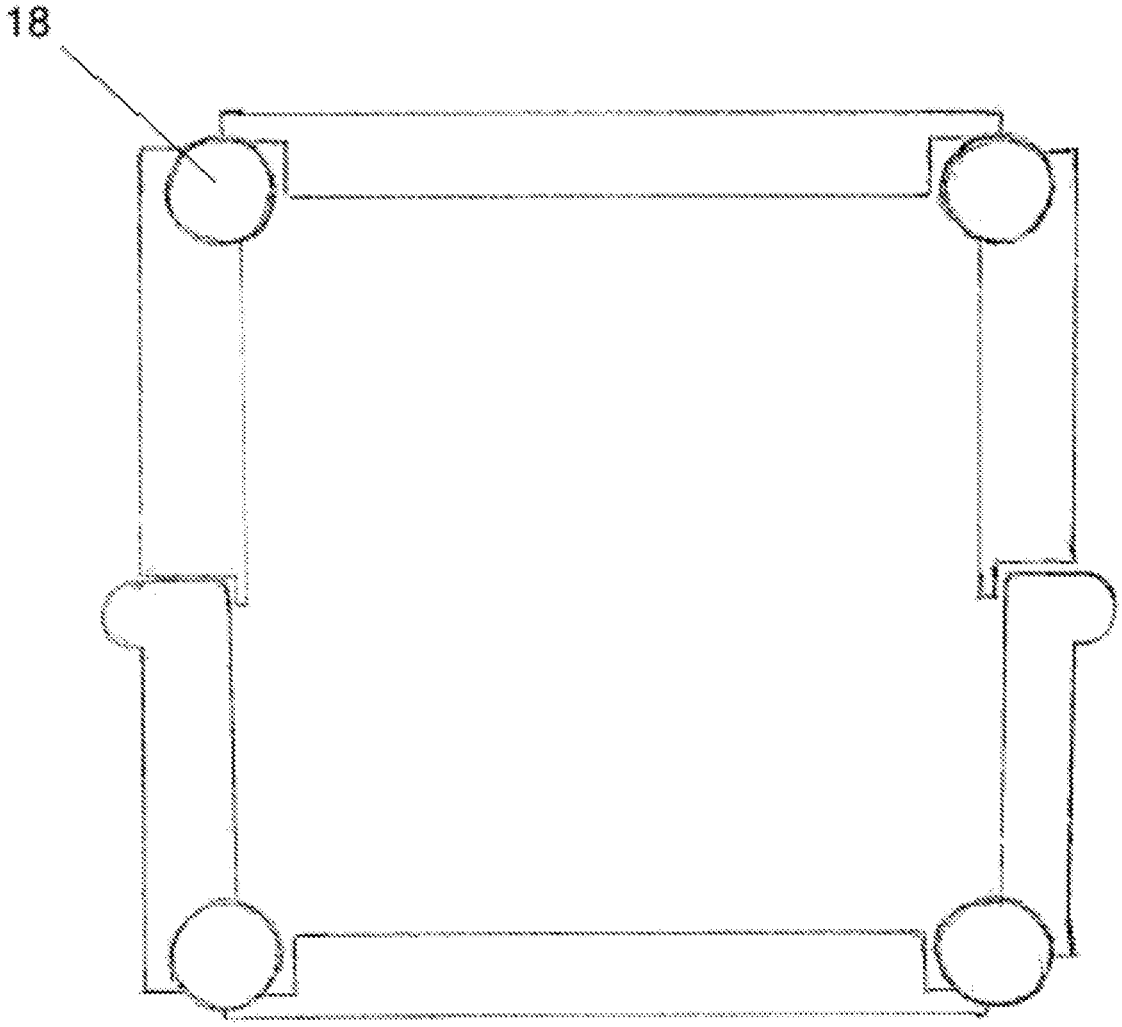
FIG. 12 is a bottom view of the apparatus showing suction cups that are placed on a Lazy Susan allowing the apparatus to rotate so that you can access all sides.
Figure 13:
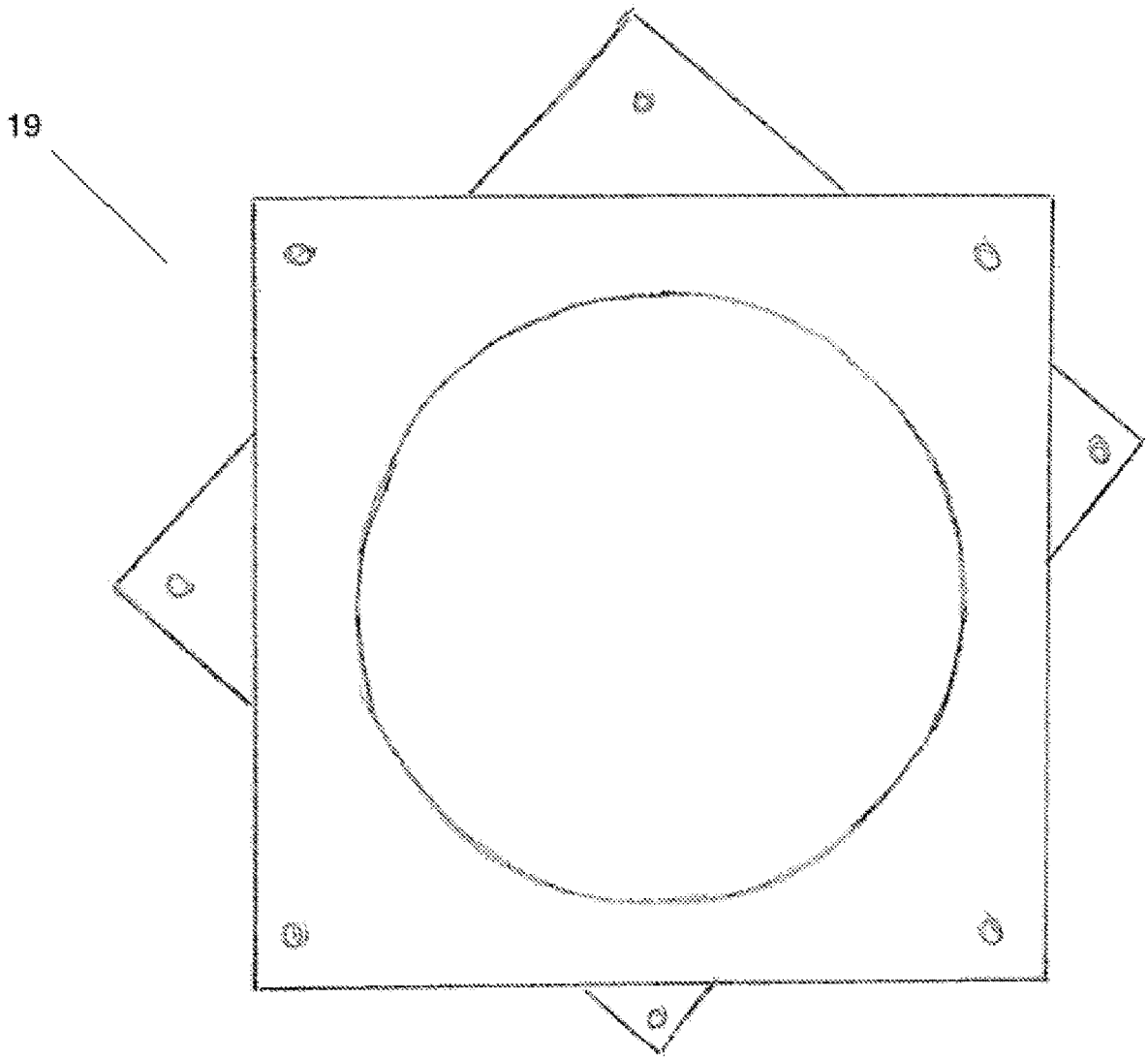
FIG. 13 is a view of a Lazy Susan that is placed on bottom of apparatus and on top when adding another Shoe Stax Pro.
Figure 13A:
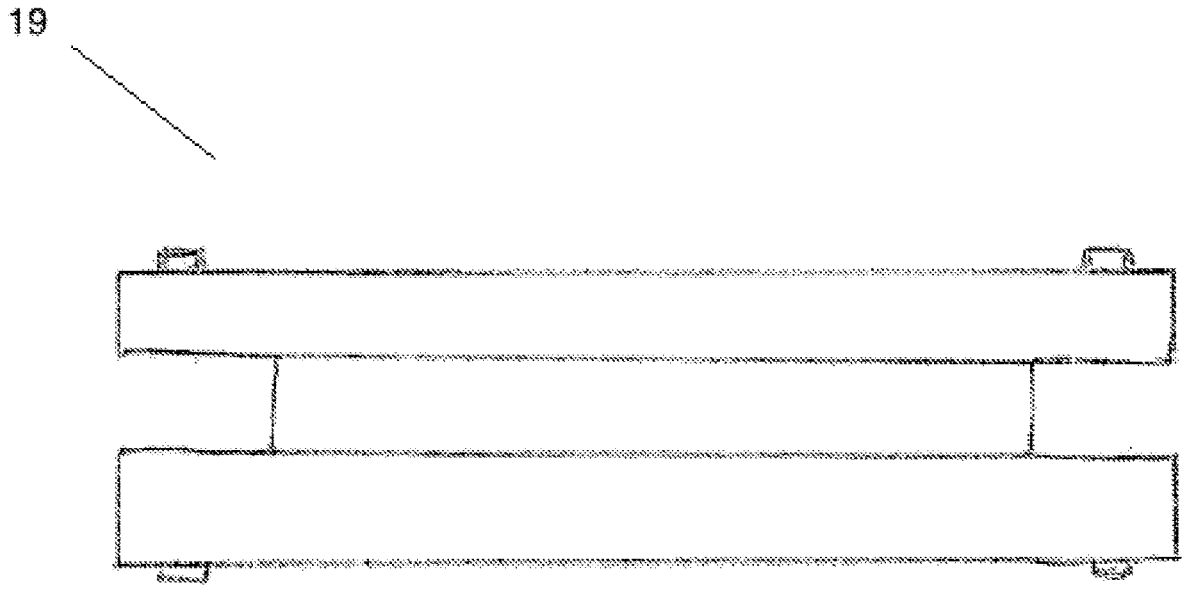
FIG. 13A is a side view of a Lazy Susan.
Figure 14:
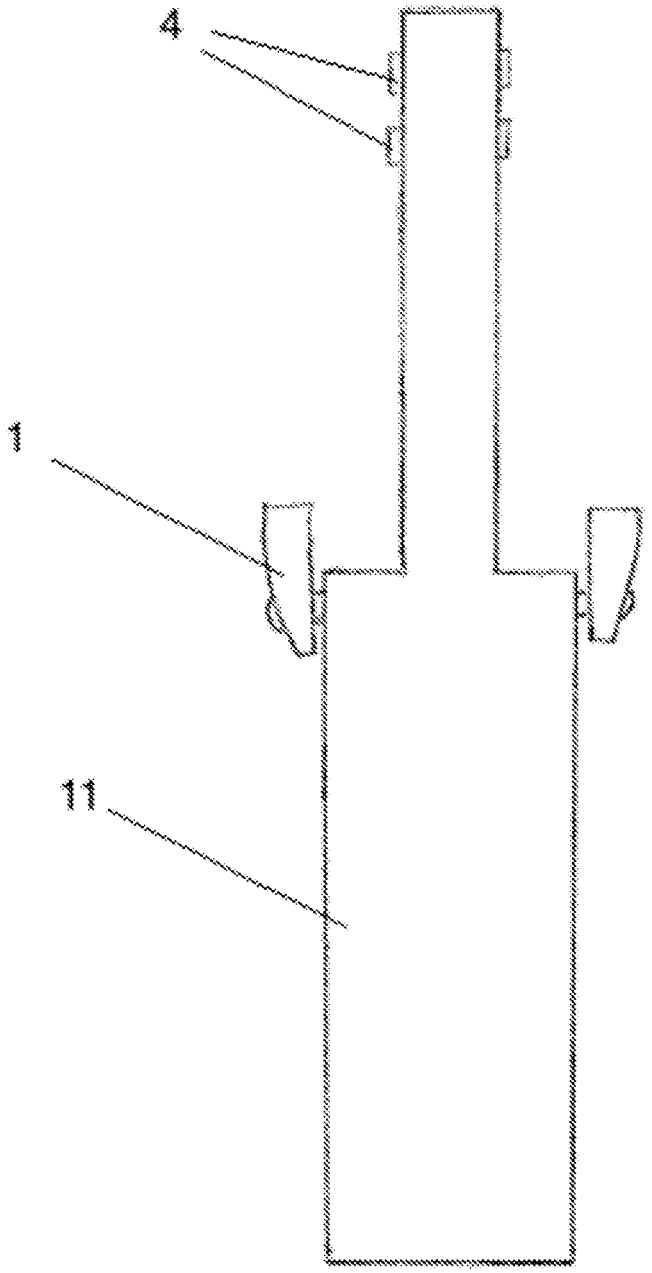
FIG. 14 is a side view of slat showing holding clips for holding tong in place.

The apparatus is rotatable so that shoes are accessible on all sides. Rotation is accomplished by the utilization of a Lazy Susan like device 19. This device sits at the bottom of the apparatus. As best seen in FIG. 12 suction cups 18 may be disposed on the bottom of the shoe holder, which is then placed on the Lazy Susan 19 allowing the apparatus to rotate so that the user can access all sides. It is again utilized when stacking one Shoes Stax Pro atop another. When shipping or in storage, the tongs 7 are held in place by holding clips 1. Releasing the holding clip 1 by turning either left or right, releases the tong 7. The tong 7 is then extended to an upright position of a 10° angle as seen in FIG. 4. Shoes are the hung on the tong 7 as seen in FIG. 1. While the shoe is on the tong 7, further stabilization is provided by cutouts 6 on the slats 11.

Tongs 7 are located back-to-back on cross slats 12 of the device. Beneath each tong 7 and connecting the tong 7 to the cross slat 12, are torsion springs 5 and metal bars 2. As shown in the Figures, metal bars 1 are disposed within the coil portions 15 of torsion springs 5 and have ends which are accommodated in holes 3 in cross slats 12. Springs 5 allow tongs 7 to hold a pair of shoes in an upright fashion, allowing for the increased storage space inherent in this device.

While a shoe is hanging on a tong 7, cutouts 6, which are located on each slat 11, prevent a shoe 100 from possibly moving from side to side. The tip or front part of a shoe 100 would rest in this area of cutout 6 when hanging from the tong 7.

The invention claimed is:

1. A shoe holder comprising:

a first foldable box-shaped structure comprising four sides, each side hingedly attached to two neighboring sides, each side comprising a plurality of slats disposed vertically and joined by a cross-slat disposed horizontally at a top end of the plurality of slats, each slat having an outer surface disposed on an outside of the first foldable box-shaped structure and an inner surface disposed on an inside of the first foldable box-shaped structure;

a first shoe-holding structure disposed on the outer surface of each slat, the first shoe-holding structure comprising a tong, the tong sized and shaped to fit inside a shoe, the tong hingedly attached to the cross-slat, a torsion spring disposed between the slat and the tong, the torsion spring comprising a coil portion, a first arm disposed at a first end of the coil portion and a second arm disposed at a second end of the coil portion, the first arm attached by a first spring support holder to the tong and the second arm attached by a second spring support holder to the slat, the tong and torsion spring connected to the cross-slat by a cross bar passing through the coil portion of the torsion spring and through a knuckle of the tong, the cross bar received in holes of the cross-slat, the tong having a first position for holding a shoe in which it is supported by the torsion spring at an angle away from the slat, and a second position in which it is folded against the slat and held in the second position by a holding clip pivotably attached to the slat.

2. The shoe holder of claim 1 wherein the first shoe-holding structure further comprises a cutout on each slat disposed below the tong and adapted to receive a toe of the shoe supported by the tong.

3. The shoe holder of claim 1 wherein the angle is 10 degrees.

4. The shoe holder of claim 1 further comprising a second shoe-holding structure disposed on the inner surface of each slat.

5. The shoe holder of claim 4 wherein the second shoe-holding structure has the same structure as the first shoe-holding structure.

6. The shoe holder of claim 1 wherein the cross-slat of each side has a first end and a second end, a single knuckle disposed on the first end of the cross-slat having a pair of knob holes formed therein, and a pair of knuckles disposed on the second end of the cross-slat, each of the pair of knuckles having a raised knob formed thereon, the pair of knuckles adapted to receive between them the single knuckle of the cross-slat of a neighboring side and the raised knobs adapted to be received in the knob holes of the single knuckle of the cross-slat of the neighboring side, thereby hingedly attaching each side to two neighboring sides.

7. The shoe holder of claim 1 wherein an outer surface of the tong has a curvature allowing the tong to fit comfortably inside the shoe.

8. The shoe holder of claim 1 wherein the first foldable box-shaped structure is disposed upon a Lazy Susan for rotation of the shoe holder so that all sides of the first foldable box-shaped structure are accessible to a user.

9. The shoe holder of claim 1 further comprising a second foldable box-shaped structure rotatably disposed on a top of the first foldable box-shaped structure and having the same structure as the first foldable box-shaped structure.

10. The shoe holder of claim 1 wherein each side comprises two slats.

11. The shoe holder of claim 1 wherein the four sides comprise a front side, a rear side, a left side and a right side; and wherein the front side and rear side each comprise six slats, and the left side and a right side each comprise two slats.

* * * * *